US006240974B1

(12) United States Patent
Hehle

(10) Patent No.: US 6,240,974 B1
(45) Date of Patent: Jun. 5, 2001

(54) APPARATUS FOR CONTROLLING THE TENSION OF CATCH SELVAGE YARN IN A WEAVING LOOM

(75) Inventor: Josef Hehle, Hoerbranz (AU)

(73) Assignee: Lindauer Dornier GmbH (DE)

( * ) Notice: Subject to any disclaimer, the term of this patent is extended or adjusted under 35 U.S.C. 154(b) by 0 days.

(21) Appl. No.: 09/552,637

(22) Filed: Apr. 19, 2000

(30) Foreign Application Priority Data

Apr. 21, 1999 (DE) ..... 199 17 952

(51) Int. Cl.[7] ..... D03D 49/08

(52) U.S. Cl. ..... 139/430; 242/129.8; 242/419.2; 242/421.2; 139/106; 188/65.3

(58) Field of Search ..... 242/590, 563, 242/129.8, 419.2, 421.2; 139/430, 106, 102; 28/191; 188/65.3

(56) References Cited

U.S. PATENT DOCUMENTS 631,430 * 8/1899 Perham ..... 139/107
4,485,849 * 12/1984 Franks ..... 139/107

FOREIGN PATENT DOCUMENTS 610604 4/1979 (CH) .
2129817 12/1971 (DE) .
2421748 11/1974 (DE) .

* cited by examiner

*Primary Examiner*—Andy Falik
(74) *Attorney, Agent, or Firm*—W. F. Fasse; W. G. Fasse

(57) ABSTRACT

The tension of catch selvage yarns reeling off a yarn supply spool is kept constant by applying a braking force to the supply spool by a disk brake. The brake has a brake disk (12) rotating with the yarn supply spool (1') and a position variable brake component (20) which is responsive in its instantaneous position to the instantaneous diameter of a yarn supply on the supply spool (1') as sensed by a yarn follower (8) such as a roller that contacts the yarn on the spool, preferably under a spring bias.

12 Claims, 3 Drawing Sheets

APPARATUS FOR CONTROLLING THE TENSION OF CATCH SELVAGE YARN IN A WEAVING LOOM

PRIORITY CLAIM

This application is based on and claims the priority under 35 U.S.C. §119 of German Patent Application 199 17 952, filed on Apr. 21, 1999, the entire disclosure of which is incorporated herein by reference.

FIELD OF THE INVENTION

The tension of catch selvage yarn in a weaving loom is kept substantially constant by a brake mechanism effective on the catch selvage yarn supply spool.

BACKGROUND INFORMATION

It is known to influence and maintain the tension of catch selvage yarns in a loom in various ways. Without such efforts the tension changes as the yarn is withdrawn from the selvage yarn supply spool. The yarns are supplied by a so-called selvage spool rotatably mounted in the loom frame for producing the catch selvage of a fabric. The catch selvage is later cut off. The selvage yarn spool, hereafter referred to as supply spool, carries the selvage yarn wound onto the spool and the yarn diameter of the spool diminishes or becomes less and less as the yarn is used up during the weaving process. The yarn content or the diameter of the yarn wound onto the supply spool is sensed by a yarn follower roller. The tension on the yarn as it is pulled off the supply roller is influenced by a braking action, whereby the yarn follower roller and the brake components follow the variable diameter of the yarn coil wound onto the supply spool in response to a spring action. The follower roller and the brake components operate in synchronism.

It is known to influence and maintain a desired tension force on the catch selvage yarn or yarns with the aid of at least one so-called looping brake as shown in present FIG. 1 to be described in more detail below. These catch selvage yarns are pulled off the supply spool during weaving by the tension applied to the selvage yarn. The looping brake controls the rotation of the supply spool and thus the tension force on the yarn. These conventional looping brakes comprise a spring tensioned brake tape or belt that loops around a supply spool flange, whereby so-called tension peaks in the selvage yarns and respective yarn breaks are unavoidable. A desired constant tension cannot be applied to the selvage yarns and yarn breaks cannot be reduced with the help of a looping brake so that there is room for improvement in such a conventional looping brake system.

German Patent Publication DE 2,421,748 C2 (Kovar et al.) discloses an apparatus for equalizing the tension on two binding threads in a leno selvage device also employing a looping brake.

German Patent Publication DE OS 2,129,817 (Mullekom) discloses a thread brake for maintaining a constant thread tension in the leno threads of a leno device for forming a leno selvage in a fabric. The Mullekom thread brake includes a bail that reaches around the flange of the leno thread spool. The bail is mounted at the end of a mounting arm the other end of which is pivotably mounted between two support lugs on the leno disk. A sensor or follower roller is provided on one side of the bail and a tension spring connected to the mounting arm of the bail is effective to keep the follower roller in contact with the thread supply on the leno thread supply spool. Brake elements are provided on the bail for keeping the leno thread tension constant. These brake elements are effective on both sides of a flange of the leno thread supply spool. Such a structure has the disadvantage that the braking elements are effective directly on the flange of the leno thread supply spool which damages the spool body in a relatively short time to such an extent that the spool body must be replaced. The damage manifests itself in so-called brake track grooves which, when the spool body is reused or refilled with leno yarn, the yarn becomes entangled in the brake grooves when thread is being pulled off the supply spool, particularly on the yarn facing side of the spool flange, whereby the thread can get caught and stuck to eventually tear.

OBJECTS OF THE INVENTION

In view of the above it is the aim of the invention to achieve the following objects singly or in combination:

- to provide a brake mechanism for a catch selvage yarn supply spool which will advantageously control and maintain constant the tension in the catch selvage yarns during weaving of a fabric even if the production of the catch selvage is periodically interrupted;
- to apply a brake action to the supply spool in such a way that the thread tension is maintained constant even if the volume of selvage yarn still on the supply spool diminishes during weaving;
- to gently apply the braking action to the supply spool without damaging the spool nor the selvage yarn or yarns;
- to realize a breaking force that remains constant during the entire payout of selvage yarns from the time the full spool starts to reel off yarn until the time the spool is empty;
- to avoid tension peaks on the selvage yarn during the payout from the supply spool; and
- to apply the braking force to an easily exchangeable brake element that rotates in synchronism with the supply spool.

SUMMARY OF THE INVENTION

The above objects of the invention have been achieved by an apparatus for controlling the tension of catch selvage yarns in a loom including a loom frame member. The apparatus according to the invention is characterized by the combination of the following features. A selvage yarn supply spool for dispensing selvage yarn from the supply spool is rotatably mounted by a spool shaft to the loom frame member. Preferably, the supply spool is rotatable relative to the spool shaft. However, the spool shaft may be rotatable relative to the frame member. In both instances, the rotation is about a spool axis in response to the pull applied to the yarns being reeled off the spool. A yarn follower for contacting the supply of catch selvage yarn on the supply roller is secured through a yarn follower mounting to the loom frame member. Either the yarn follower is rotatable relative to its mounting or the mounting is rotatable relative to the loom frame member. The present brake mechanism comprises a first brake member rotating with the supply spool and a second brake member operatively secured to the yarn follower mounting for rotation or tilting in synchronism with the yarn follower so that the second brake member on the one hand responds to the motion of the yarn follower and on the other hand cooperates with the first brake member in applying a constant braking action to the supply spool in response to the instantaneous radial position of the yarn follower, whereby the second brake member follows in synchronism the motion of the yarn follower. More specifically, as the yarn supply on the supply spool diminishes, the yarn follower moves radially inwardly of the supply spool and so does the second brake member.

In the preferred embodiment the first brake member is a replaceable brake disk that is mounted on the shaft that also carries the selvage yarn supply spool. The brake disk is rigidly engaged with a spool flange for synchronous rotation with the supply spool on the one hand while the second brake member that faces one side of the brake disk can move radially relative to the brake disk in response to the motion of the yarn follower which preferably is a follower roller in contact with the yarn on the spool. Thus, a constant brake force is applied to the spool and to the yarn at all times during yarn payout.

An advantageous embodiment of the invention employs a torsion spring for assuring proper contact between the yarn follower roller and the diminishing yarn supply on the spool. One end of the torsion spring engages, for example, the loom frame member while the other end engages a lever arm or mounting arm that carries at its free end the yarn follower roller.

An important advantage of the invention is seen in that the tension on the selvage yarn remains constant at all times during payout of yarn from the spool from the beginning of the payout until the spool is empty. Thus, tension peaks on the catch selvage yarns are avoided, which in turn has the advantage that yarn breaks are substantially avoided, taking into account yarn breakage due to other causes.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
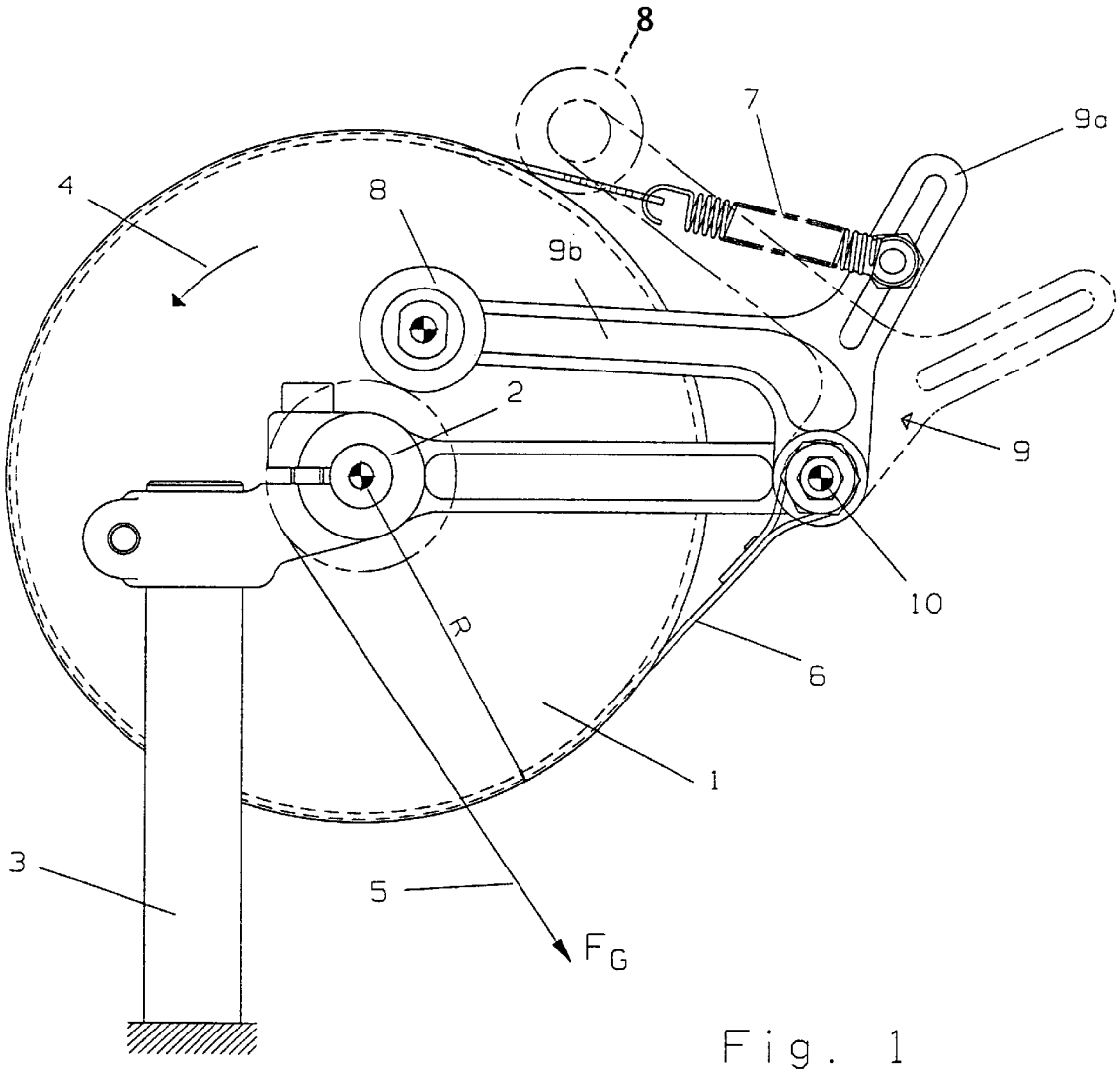
Fig. 1 PRIOR ART
FIG. 1 is a side view of a so-called looping brake in which the brake action is applied to a flange of a selvage yarn supply spool by a tape or belt looping around the flange.

FIG. 1 shows a conventional catch selvage spool 1 rotatably mounted on an axle or shaft 2 rigidly secured to a loom frame member 3. The spool 1 is rotatable on the axle 2 in the direction of the arrow 4. Catch selvage yarns or yarns 5 are wound onto the spool 1 and are pulled off the spool in the direction of the arrow $F_G$ which indicates the pulling force effective on the yarns 5. This pulling force rotates the spool 1. For a proper operation and dispensing of the catch selvage yarns 5, it is necessary to keep these yarns under a sufficient tension force, particularly during the weaving just as is necessary, for example for the warp threads. The rotation of the supply spool 1 must be influenced or controlled accordingly to achieve this purpose. Conventionally, this control of the rotation of the spool 1 is accomplished by a so-called looping brake comprising a tape or belt 6 that loops around a flange of the spool 1. One end of the tape or belt 6 is secured to a journal 10 of a bellcrank lever 9 having two arms 9A and 9B. The other end of the tape or belt 6 is connected through a tension spring 7 to the bellcrank lever arm 9A. The tension spring 7 applies a braking action to the spool 1. The braking action is proportional to the diameter R of the yarn supply on the spool 1. As shown in FIG. 1 the spool is full of yarn with R extending to the periphery of the spool. A yarn follower roller 8 is rotatably secured to the second bellcrank lever arm 9B, whereby the spring 7 keeps the follower roller 8 in contact with the yarn 5 on the spool 1. The roller 8 shown in full lines contacts a spool that is almost empty. The roller 8 shown in dashed lines contacts a spool 1 full of yarn. Thus, the braking action on the spool 1 is responsive to the diminishing yarn diameter on the spool 1. A corresponding tension force is applied to the catch selvage yarns 5 depending on the spring constant of the tension spring 7. The axis of the journal 10 for the bellcrank 9 is positioned approximately in parallel to the rotational axis 2 of the spool 1 and outside of the outer flange diameter of the spool 1.

Figure 2:
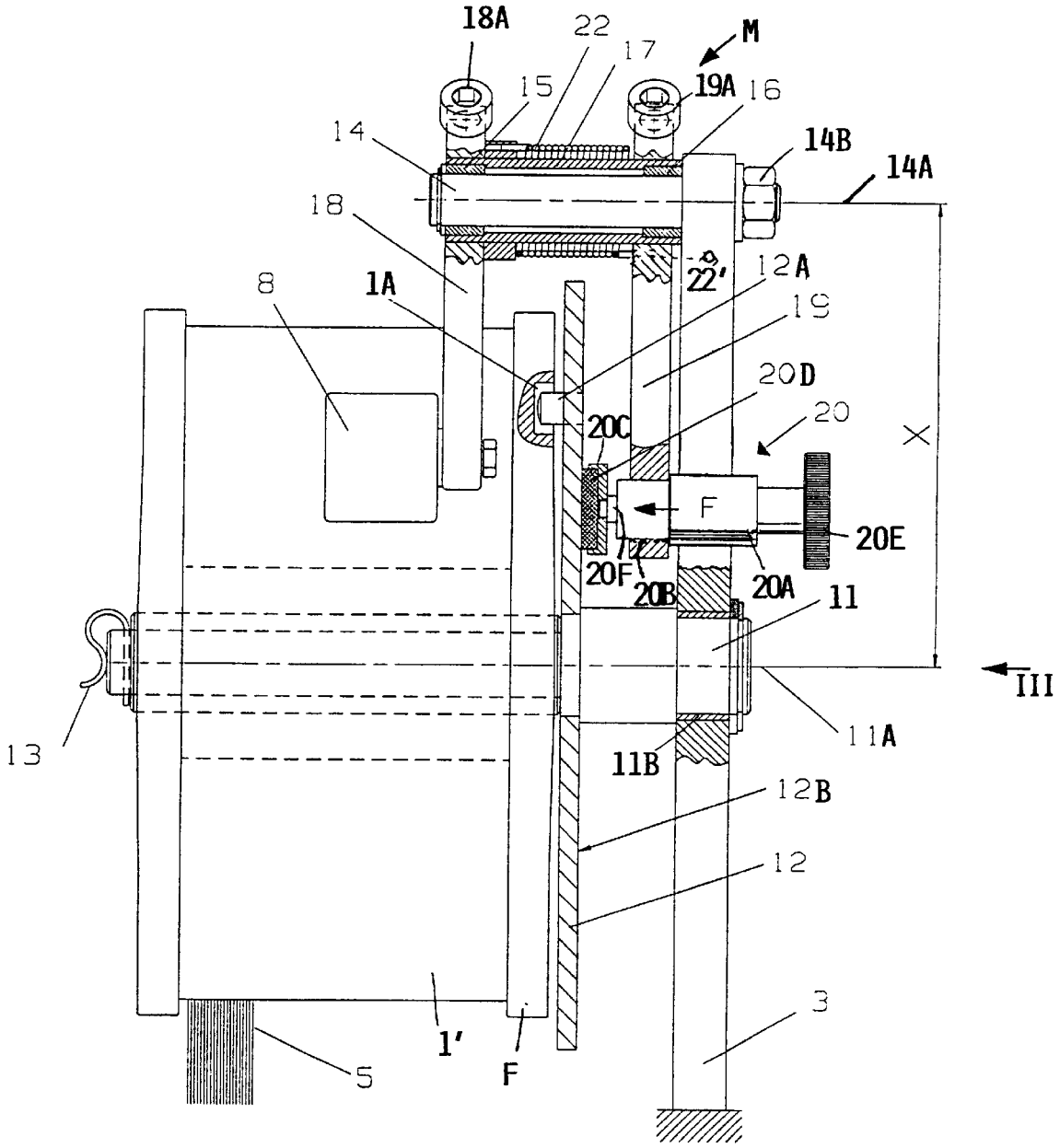
FIG. 2 is an elevational view partially in section, of a selvage yarn supply spool and brake combination according to the invention.

FIG. 2 shows a spool and brake combination according to the invention. The catch selvage yarn supply spool 1 has wound thereon several catch selvage yarns 5. A shaft 11 having a central rotational axis 11A is mounted for rotation in a bearing 11B supported in a machine frame member 3. A brake disk 12 forming a first brake member is coaxially mounted on the shaft 11 for rotation with the shaft. The selvage yarn supply spool 1' is mounted on the free end of the shaft 11 and axial displacement of the spool 1' is prevented, for example by a cotter pin 13 or the like. The spool 1' has a flange F with a recess 1A engaged by an entraining stub 12A of the brake disk 12, whereby the spool 1' rotates in synchronism with the brake disk 12. The surface of the brake disk 12 facing away from the spool 1', or rather from the flange F, is preferably provided with a friction enhancing brake lining or coating 12B.

A mounting M includes an axle 14 having a central axis 14A. The axle 14 is rigidly secured to the loom frame member 3 by screw elements 14B. The central axis 14A extends in parallel to the rotational axis 11A of the shaft 11 at a spacing X which is larger than the maximum diameter of the spool 1' when the spool 1' is full of yarn 5. The mounting M supports a yarn follower such as a roller 8 and second brake elements 20 as will be described in more detail below. For this purpose, the axle 14 carries a bearing bushing 17 rotatably mounted on the axle 14 by at least one, preferably two bearings 15 and 16 which may be antifriction bearings or roller bearings or ball bearings or the bushing itself may comprise antifriction elements. The yarn follower roller 8 is rotatably secured to a free end of a first mounting arm 18. The other end of the arm 18 is rigidly, but releasably secured to one end of the bearing bushing 17, for example by a set screw 18A. A torsion spring 22 surrounds the bushing 17. One end of the torsion spring 22 is secured to the arm 18 and thus to the bearing bushing 17. The other end 22' of the torsion spring 22 is secured to the fixed frame member 3. By loosening the set screw 18A and turning the arm 18 around the axis 14A, the torsion moment of the spring 22 can be adjusted for the purpose of always keeping the roller 8 in contact with the surface of the coil of yarn on the spool 1'. After proper adjustment the set screw 18A is tightened again.

The mounting M further carries a second mounting arm 19 secured to the bushing 17 by a set screw 19A or the like, whereby the arm 19 may also be adjusted in its position around the axis 14A when the set screw 19A is loosened. After adjustment the screw 19A is tightened again. The arm 19 carries at its free end the second brake elements 20 that cooperate with the first brake element or disk 12. The second brake elements 20 comprise a brake pin 20A having a male threaded end 20B that carries a brake shoe 20C. A brake pad 20D is mounted to the brake shoe 20C. The male threaded end 20B is received in a female threaded free end of the second mounting arm 19, whereby an applied brake force F can be adjusted by rotating the brake pin 20A, for example, with the aid of a knurled handle 20E. The handle 20E may, for example, be replaced by a screwdriver slot, a wrench head, or the like. Rather than adjusting the entire brake pin 20A relative to the arm 19, it is possible to rigidly secure the brake pin 20A to the free end of the arm 19 and adjust the brake shoe 20C relative to the brake pin 20A. For this purpose the brake shoe 20C would not be rigidly secured to the brake pin 20A. Rather, a brake shoe stem 20F would be slidingly or rotatably received in the brake pin 20A for adjustment in the direction of the arrow F indicating the applied brake force that presses the brake pad 20D against the lining 12B of the brake disk 12. This brake arrangement has the advantage that the brake disk 12 and/or the brake pad 20D are easily exchanged, if necessary.

Figure 3:
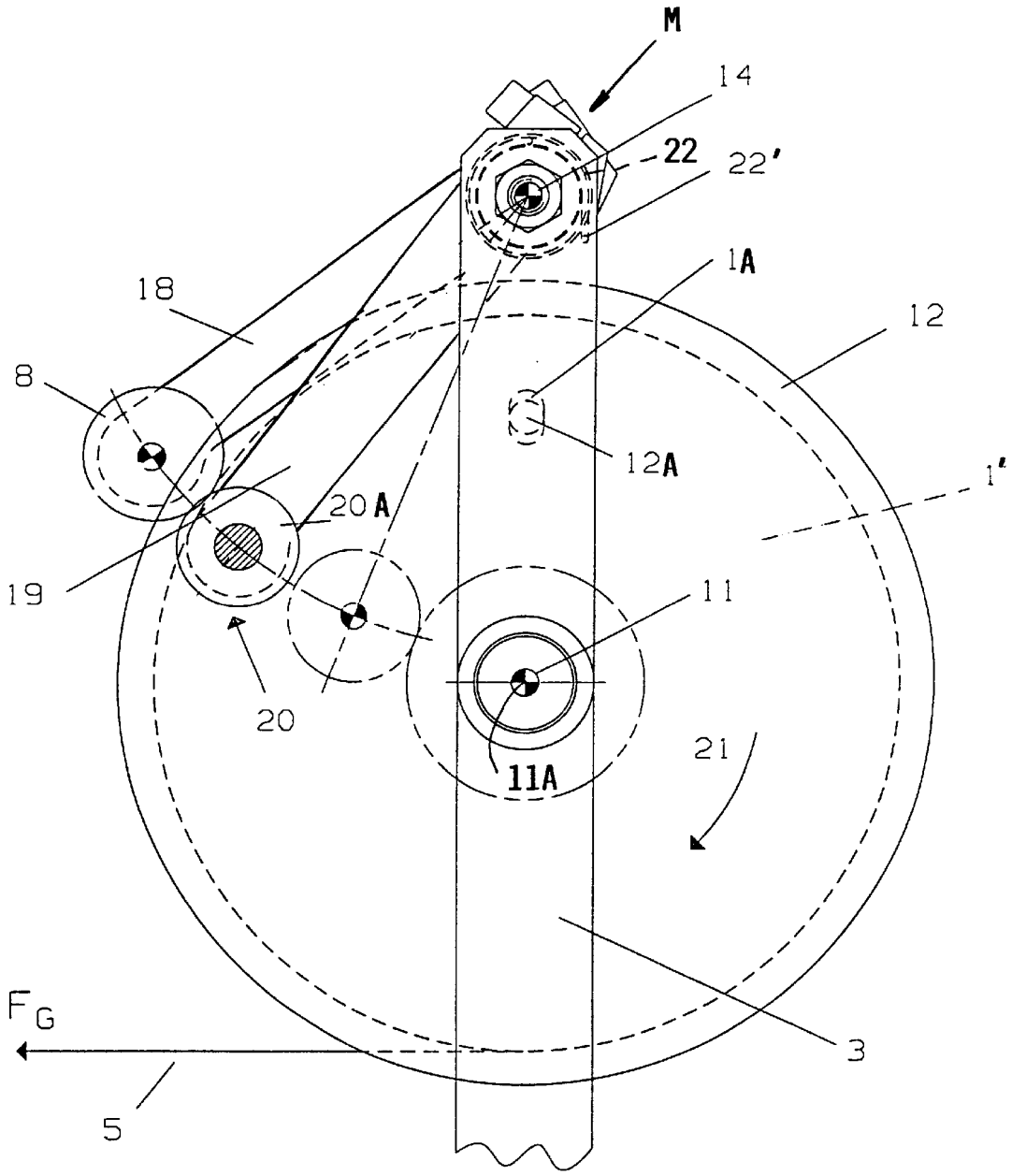
FIG. 3 is a view in the direction of the arrow III in FIG. 2 to illustrate the synchronized motion of the yarn follower and the brake of the invention.

FIG. 3 illustrates the operation of the brake mechanism according to the invention. The spool 1' is filled with catch selvage yarns 5. A yarn tension force F is effective on the yarns 5 to rotate the spool 1' in the direction of the arrow 21. The yarn follower roller 8 rides on the top surface of the coil of yarn on the spool 1' urged by the spring 22 to maintain the contact between the roller 8 and the surface of the yarn when the yarn diminishes. The second brake elements 20 bear against the surface 12B of the brake disk 12 with the brake pad 20D under the brake force F adjusted as described above with reference to FIG. 2. The second mounting arm 19 follows the radially inward motion of the first mounting arm 18 because both arms 18 and 19 are rigidly secured to the bushing 17 as described above, as the winding diameter of the yarn on the spool 1' diminishes so that a constant tension is applied to the yarns 5 throughout the unwinding operation until the spool 1' is empty. As mentioned, the torsion spring 22 makes sure that the roller 8 at the free end of the arm 18 remains in contact with the surface of the yarn coil on the spool 1'. For this purpose, the spring 22 is effective between the bushing 17 and the frame member 3.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for controlling the tension of catch selvage yarn in a loom including a loom frame member (3), said apparatus comprising a selvage yarn supply spool (1') for dispensing selvage yarn (5) from said supply spool, a spool shaft (11) adapted for rotatably mounting said supply spool to said loom frame member (3) for rotation about a spool axis (11A), a yarn follower (8) for contacting a supply of catch selvage yarn on said supply spool (1'), a mounting (M) for rotatably securing said yarn follower (8) to said loom frame member (3), a brake mechanism comprising a first brake member (12) rotating with said supply spool (1') and at least one second brake member (20A) operatively secured to said mounting for rotation or tilting in synchronism with said yarn follower (8), so that said at least one second brake member cooperates with said first brake member (12) in applying a braking action to said supply spool (1') in response to the instantaneous radial position of said yarn follower.

2. The apparatus of claim 1, wherein said mounting (M) comprises a first mounting arm (18), wherein said yarn follower (8) comprises a roller rotatably mounted to a free end of said first mounting arm (18), said mounting (M) further comprising a second mounting arm (19), wherein said at least one second brake member (20) is adjustably secured to a free end of said second mounting arm (19), said mounting (M) further comprising a support member (14) adapted to be operatively secured to said loom frame member (3), and wherein said first mounting arm (18) and said second mounting arm (19) are tiltably mounted to said support member (14).

3. The apparatus of claim 2, wherein said mounting (M) further comprises a bearing bushing (17), at least one bearing (15, 16) rotatably mounting said bearing bushing on said support member (14), means (14B) adapted for rigidly securing said support member (14) to said loom frame member (3), and wherein said first and second mounting arms (18, 19) are rigidly secured to said bearing bushing (17) for rotation with said bearing bushing (17).

4. The apparatus of claim 2, wherein said support member (14) has a central axis (14A) extending in parallel to said spool axis (11A).

5. The apparatus of claim 1, further comprising a torsion spring (22) as part of said mounting (M) for keeping said yarn follower (8) in contact with yarn on said supply spool (1') as the yarn supply on said supply spool becomes less and less.

6. The apparatus of claim 1, wherein said first brake member (12) comprises a brake disk mounted on said spool shaft for synchronized rotation with said yarn supply spool (1').

7. The apparatus of claim 6, further comprising means (lA, 12A) engaging said brake disk (12) with said supply spool for rotation with said supply spool.

8. The apparatus of claim 7, wherein said engaging means comprise a pin (12A) and a recess (lA) engaged by said pin, whereby said brake disk (12) rotates in unison with said yarn supply spool (1').

9. The apparatus of claim 2, wherein said at least one second brake member comprises a brake pin (20A) having a male threaded pin end (20B), said second mounting arm (19) including a free end with a female threading in which said male threaded pin end (20B) is adjustably received, and a brake shoe (20C) secured to said pin end (20B) for contacting said first brake member (12).

10. The apparatus of claim 9, further comprising a friction brake pad (20D) mounted to said brake shoe (20C) for contacting said first brake member (12).

11. The apparatus of claim 9, wherein said first brake member (12) is a brake disk including a brake lining (12B) facing axially away from said supply spool (1) toward said at least one second brake member.

12. The apparatus of claim 9, wherein said brake pin (20A) comprises an adjustment element (20E) opposite said male threaded pin end (20B) for adjusting a brake force (F).

* * * * *